US010772784B2

(12) United States Patent
Yang et al.

(10) Patent No.: US 10,772,784 B2
(45) Date of Patent: Sep. 15, 2020

(54) CORRUGATED TUBE

(71) Applicants: BEIJING HENGTONG XINJIA TECHNOLOGY DEVELOPMENT CO, LTD., Beijing (CN); ZHONGSHAN CHANGYAO MEDICAL EQUIPMENT CO, LTD., Zhongshan (CN)

(72) Inventors: Keqiang Yang, Beijing (CN); Zhenwei Mao, Beijing (CN); Keijiron Yamamoto, Kanagawa (JP)

(73) Assignees: BEIJING HENGTONG XINJIA TECHNOLOGY DEVELOPMENT CO, LTD., Beijing (CN); ZHONGSHAN CHANGYAO MEDICAL EQUIPMENT CO, LTD., Zhongshan (CN)

( * ) Notice: Subject to any disclaimer, the term of this patent is extended or adjusted under 35 U.S.C. 154(b) by 0 days.

(21) Appl. No.: 16/626,327

(22) PCT Filed: Jul. 3, 2018

(86) PCT No.: PCT/CN2018/094196

§ 371 (c)(1),
(2) Date: Dec. 24, 2019

(87) PCT Pub. No.: WO2019/007311

PCT Pub. Date: Jan. 10, 2019

(65) Prior Publication Data

US 2020/0113769 A1 Apr. 16, 2020

(30) Foreign Application Priority Data

Jul. 7, 2017 (CN) ..... 2017 1 0551749

(51) Int. Cl.
*A61H 1/02* (2006.01)

(52) U.S. Cl.
CPC ..... *A61H 1/0288* (2013.01); *A61H 2205/067* (2013.01)

(58) Field of Classification Search
CPC ..... A61H 1/0288; A61H 2205/067
(Continued)

(56) References Cited

U.S. PATENT DOCUMENTS 3,794,080 A * 2/1974 Huston ..... F16L 11/111 138/121
4,131,407 A * 12/1978 de Putter ..... B29C 57/02 425/393

(Continued)

FOREIGN PATENT DOCUMENTS

CN 104970949 A 10/2015
CN 204995747 U 1/2016

(Continued)

*Primary Examiner* — Craig M Schneider
*Assistant Examiner* — David R Deal
(74) *Attorney, Agent, or Firm* — Bayramoglu Law Offices LLC

(57) ABSTRACT

A corrugated tube includes a hollow tube formed of several crests and several troughs connected alternately. The middle of an end face of a tail end of the corrugated tube is provided with a boss; and both a first section of a head end and a last section of a tail end of the corrugated tube are crests, with the width of both the crest of the first section of the head end and the crest of the last section of the tail end being greater than the thickness of the corrugated tube, preventing the tail end and the head end of the corrugated tube from collapsing inwards when the air pressure in the corrugated tube decreases.

6 Claims, 1 Drawing Sheet

(58) Field of Classification Search
USPC ..... 138/121, 109
See application file for complete search history.

(56) References Cited

U.S. PATENT DOCUMENTS

| | | | | |
|---|---|---|---|---|
| 4,150,087 | A * | 4/1979 | de Putter | B29C 57/02 264/296 |
| 4,915,425 | A * | 4/1990 | Hegler | F16L 9/18 285/179 |
| 5,996,635 | A * | 12/1999 | Hegler | B29C 57/04 138/109 |
| 6,199,592 | B1 * | 3/2001 | Siferd | B29C 57/00 138/109 |
| 9,138,274 | B1 * | 9/2015 | Biesinger | A61B 17/7225 |
| 2004/0226623 | A1 * | 11/2004 | Chenoweth | B32B 27/34 138/121 |
| 2007/0051417 | A1 * | 3/2007 | Boettner | F16L 37/084 138/121 |
| 2010/0126616 | A1 * | 5/2010 | Kanao | F16L 47/065 138/122 |
| 2010/0269945 | A1 * | 10/2010 | Hegler | B29C 49/0021 138/142 |
| 2017/0020763 | A1 | 1/2017 | Cruz | |

FOREIGN PATENT DOCUMENTS

| | | | |
|---|---|---|---|
| CN | 106074074 | A | 11/2016 |
| CN | 106309083 | A | 1/2017 |
| CN | 106880470 | A | 6/2017 |
| CN | 107184364 | A | 9/2017 |
| JP | 2016159049 | A | 9/2016 |
| WO | 2011043095 | A1 | 4/2011 |
| WO | 2017110453 | A1 | 6/2017 |

* cited by examiner

CORRUGATED TUBE

CROSS REFERENCE TO THE RELATED APPLICATIONS

This application is the national phase entry of International Application No. PCT/CN2018/094196, filed on Jul. 3, 2018, which is based upon and claims priority to Chinese Patent Application No. 201710551749.9, filed on Jul. 7, 2017, the entire contents of which are incorporated herein by reference.

TECHNICAL FIELD

The present invention relates to the technical field of joint exercise aid, and in particular to a corrugated tube.

BACKGROUND

It has been clinically confirmed that during early rehabilitation and spontaneous recovery after surgery on a patient's limb or for a patient suffering from injury of cranial nerves, implementation of continuous passive exercise can compensate for patient's lack of active exercise, increase the mobility of the limb, and reduce corresponding complications at the same time. In addition, at present, patients suffer from contracture of fingers due to numbness caused by central nervous injury such as cerebral infarction, in which case, if the patient's fingers can be assisted in exercise, the recovery speed of patient's fingers can be increased.

In view of the above defects, the inventor of the present invention finally obtained the present invention after a long period of research and practice.

SUMMARY

To solve the above technical defects, the technical solution used by the present invention is to provide a corrugated tube, which is a tube, hollow inside, formed of several crests and several troughs connected alternately, wherein the middle of an end face of a tail end of the corrugated tube is provided with a boss, with the thickness of the boss being greater than the thickness of the corrugated tube; and both a first section of a head end and a last section of a tail end of the corrugated tube are crests, with the width of both the crest of the first section of the head end and the crest of the last section of the tail end being greater than the thickness of the corrugated tube, preventing the tail end and the head end of the corrugated tube from collapsing inwards when the air pressure in the corrugated tube decreases.

Preferably, the end face of the tail end of the corrugated tube is provided with a chamfer to prevent the tail end and the head end of the corrugated tube from collapsing inwards when the air pressure in the corrugated tube decreases.

Preferably, an end face of the head end of the corrugated tube is provided with an arc surface to prevent the tail end and the head end of the corrugated tube from collapsing inwards when the air pressure in the corrugated tube decreases.

Preferably, a top angle of the crest of the corrugated tube is equal to a bottom angle of the trough.

Preferably, when the top angle of the crest of the corrugated tube is an acute angle, the compression performance of the corrugated tube is greater than the stretching performance thereof.

Preferably, when the top angle of the crest of the corrugated tube is an obtuse angle, the compression performance of the corrugated tube is less than the stretching performance thereof.

Compared with the prior art, the beneficial effect of the present invention is as follows: the corrugated tube cooperates with other joint rehabilitation exercise aid parts to help patients perform rehabilitation training by controlling the air pressure in the corrugated tube, such that the corrugated tube is forced to compress and stretch and drives the patient's joints to perform exercise at the same time.

BRIEF DESCRIPTION OF THE DRAWINGS

To illustrate the technical solutions in various embodiments of the present invention more clearly, the accompanying drawings to be used in the description of the embodiments will be briefly introduced below.

DETAILED DESCRIPTION OF THE EMBODIMENTS

The above and other technical features and advantages of the present invention will be illustrated in more detail below with reference to FIGS. 1 to 3.

Figure 1:
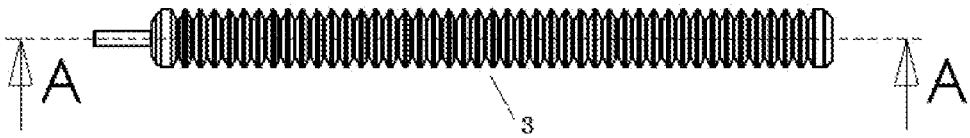
FIG. 1 is a structural diagram of a corrugated tube.

FIG. 1 is a structural diagram of a corrugated tube. The corrugated tube cooperates with a mechanism for such as fingers, toes, legs, or arms in need of assisted rehabilitation exercise, the corrugated tube is hollow inside, and the air pressure in the corrugated tube is controlled to force the corrugated tube to perform stretching and compression, so that the joints in need of rehabilitation exercise are forced to move under the drive of the stretching and compression of the corrugated tube. The material of the corrugated tube is high-pressure polyethylene (HDPE) or ethylene (EVA).

Figure 2:
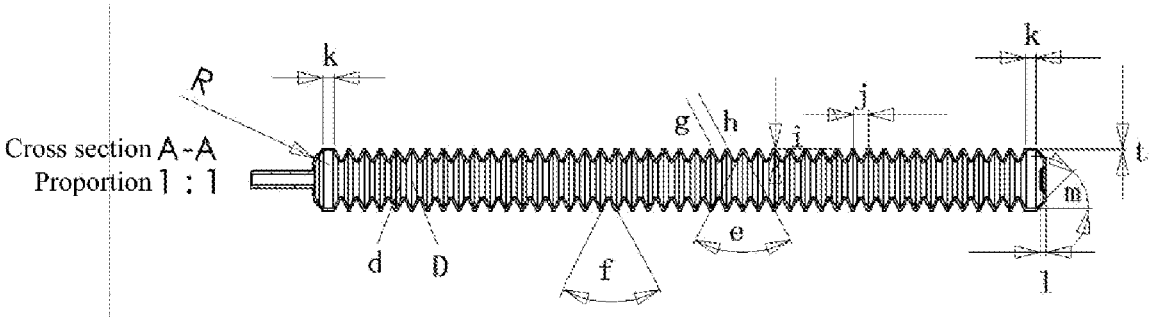
FIG. 2 is a sectional diagram of a corrugated tube.

FIG. 2 is a cross-sectional view of a corrugated tube. It can be seen from the figure that the corrugated tube is a flexible tube composed of alternating crests and troughs. The top angle e of each crest and is equal to the bottom angle f of the trough, so sides g and h of two adjacent crests in the same direction are parallel to each other. When the angles e and f are both equal to 90 degrees, the compression performance and stretching performance of the corrugated tube are equal. When the angles e and f are both an acute angle, if the angles e and f are both pulled from the acute angle to the straight angle, the stretching space is large, but the stretching resistance will also be very large, and due to the influence of the material of the corrugated tube and the excessive stretching angle, the corrugated tube will not return to the original state when the angles e and f become straight angle. On the contrary, if the corrugated tube is compressed, since it is relatively easy to compress the angles e and f from an acute angle to zero degree, and for a triangle enclosed by one crest and two troughs, since the crest at the top angle is an acute angle and thus this triangle has a relatively small stiffness at the top angle so that the two troughs are relatively easy to be compressed, the compression performance is greater than the stretching performance at this time. When the angles e and f are both an obtuse angle, it is relatively easy for the angles e and f to change from an obtuse angle to a straight angle, and for a triangle enclosed by one crest and two troughs, since the crest at the top angle is an obtuse angle and thus this triangle has a large stiffness at the top angle so that the two troughs cannot be easily compressed when being compressed, the stretching performance of the corrugated tube is greater than the compression performance at this time. For this patent, if the patient's bones bend and deform and cannot be straightened, and need to change from bending to straightening, the working state of the corrugated tube is from an original bent state to a compressed state, which requires the compression performance of the corrugated tube to be greater than the stretching performance thereof. If the patient's limb is in a straighten state and cannot be bent, then the initial state of the corrugated tube needs to correspond to the straighten state of the patient's limbs, when the patient's limb is bent, the corrugated tube needs to be stretched, at this time, the angle e and the angle f are both obtuse angle, change of the angle e and angle f from obtuse to flat angle (straightened state) encounter less resistance and are relatively easy to implement.

In FIG. 2, the angles e and f are both an acute angle, the compression performance of the corrugated tube is greater than the stretching performance, which is adapted to the case where the patient's limbs are in a bent state and need to be straightened. The larger the height difference between the crest and trough, i.e., the crest height i, the better the compression performance of the corrugated tube, but when the outer diameter D of the corrugated tube is fixed, the larger the crest height i, the less the inner diameter d, which will affect the filling volume of the corrugated tube. If a value of the thickness t of the corrugated tube is too large, it will affect the stretching performance and the compression performance thereof, and the thickness t is associated with the air pressure that the corrugated tube bears, i.e., the greater the air pressure, the greater the thickness t, the thickness of the corrugated tube used to aid in the finger exercise in FIG. 2 is 0.5 mm.

In order to prevent the corrugated tube from collapsing inwards at both ends when the corrugated tube is compressed, that is, when the air pressure in the corrugated tube becomes low, the corrugated tube is strengthened in strength at both ends, the middle of the bottom of the tail end is additionally provided with a boss with the thickness of 1, the crest width of the last section increases from t to k, and the end face is additionally provided with a chamfer m, which improves the strength of the tail end of the last corrugated tube such that when the air pressure in the corrugated tube decreases, the tail end of the corrugated tube will not collapse inwards to affect the effect in use. The crest width of the first section of the head end of the corrugated tube also increases from t to k, and the end face is additionally provided with an arc surface, which prevents the head end of the corrugated tube from collapsing inwards when the air pressure in the corrugated tube decreases.

Figure 3:
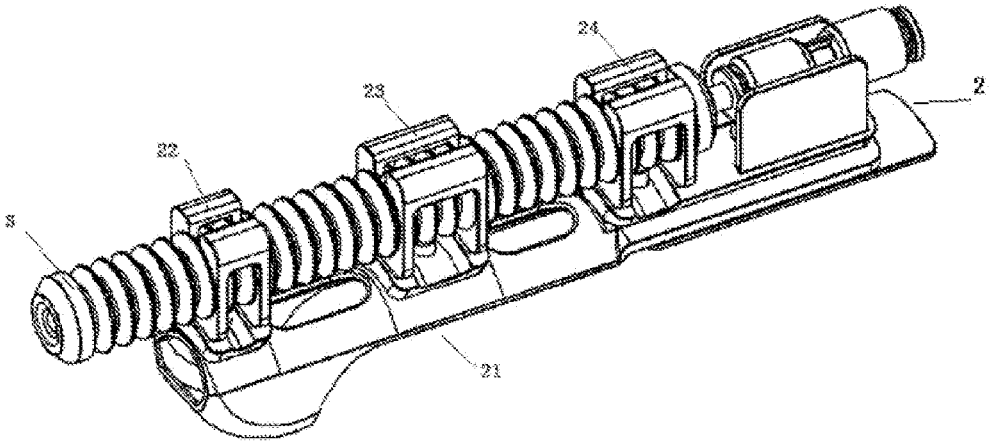
FIG. 3 is a structural diagram of a corrugated tube to be worn on a finger joint rehabilitation exercise aid part.

FIG. 3 is a structural diagram of a corrugated tube used for a finger aid part. In FIG. 3, the reference sign 3 is a corrugated tube, and the reference sign 2 is a finger joint rehabilitation exercise aid part, which comprises a rubber part 21, a small bracket 22, a middle bracket 23 and a large bracket 24. The small bracket 22, the middle bracket 23 and the large bracket 24 are all fixed on the rubber part 21, and a corrugated tube 3 is fixed by means of a small bracket 22, the middle bracket 23 and the large bracket 24. If the patient's finger is bent, when the corrugated tube is filled with air at normal pressure, the finger aid part shown in FIG. 3 is worn on the patient's finger, and at this moment, the air pressure in the corrugated tube is reduced and the corrugated tube is compressed to become straightened to drive the patient's finger to gradually straighten from bent, and this action is repeated such that the patient's finger can passively perform rehabilitation training.

Of course, the corrugated tube can also be used in other situations, such as assisting patients in bending training from a stiff state, joint rehabilitation training of the waist, legs and arms, in such cases the corrugated tube may vary in diameter, thickness and length, depending on the application.

The apparatus that controls the air pressure in the corrugated tube is any apparatus that can perform suction, compression and exhaust, such as an electric air pump, a manual air pump, a foot-operated air pump, etc.

The above are only the preferred embodiments of the present invention, and are merely illustrative but not restrictive for the present invention. It will be understood by those skilled in the art that many changes, modifications and equivalents can be made within the spirit and scope as defined by the claims of the present invention, but will fall within the scope of protection of the present invention.

What is claimed is:

1. A corrugated tube, comprising: a hollow tube formed of a plurality of crests and a plurality of troughs connected alternately, and a middle of an end face of a tail end of the corrugated tube is provided with a boss, wherein a thickness of the boss is greater than a thickness of the hollow tube; and both of a first section of a head end of the corrugated tube and a last section of the tail end of the corrugated tube comprise the plurality of crests, wherein a width of both a crest of the first section of the head end and a crest of the last section of the tail end is greater than a thickness of the corrugated tube to prevent the tail end and the head end of the corrugated tube from collapsing inwards when an air pressure in the corrugated tube decreases; wherein the end face of the tail end of the corrugated tube is provided with a chamfer to prevent the tail end and the head end of the corrugated tube from collapsing inwards when the air pressure in the corrugated tube decreases.

2. The corrugated tube according to claim 1, wherein an end face of the head end of the corrugated tube is provided with an arc surface to prevent the tail end and the head end of the corrugated tube from collapsing inwards when the air pressure in the corrugated tube decreases.

3. The corrugated tube according to claim 2, wherein a top angle of a crest of the corrugated tube is equal to a bottom angle of a trough.

4. The corrugated tube according to claim 1, wherein a top angle of a crest of the corrugated tube is equal to a bottom angle of a trough.

5. The corrugated tube according to claim 4, wherein the top angle of the crest of the corrugated tube is an acute angle.

6. The corrugated tube according to claim 4, wherein the top angle of the crest of the corrugated tube is an obtuse angle.

* * * * *